US009452627B2

(12) United States Patent
Gurberg et al.

(10) Patent No.: US 9,452,627 B2
(45) Date of Patent: Sep. 27, 2016

(54) TACTILE FEATURE TOOL

(71) Applicant: Canadian Bank Note Company, Limited, Ottawa (CA)

(72) Inventors: Barry Gurberg, Orleans (CA); Guy Watson, Carleton Place (CA); Mark Forest, Ottawa (CA)

(73) Assignee: Canadian Bank Note Company, Limited, Ottawa (CA)

( * ) Notice: Subject to any disclaimer, the term of this patent is extended or adjusted under 35 U.S.C. 154(b) by 38 days.

(21) Appl. No.: 14/348,337

(22) PCT Filed: Sep. 19, 2012

(86) PCT No.: PCT/CA2012/050649

§ 371 (c)(1),
(2) Date: Mar. 28, 2014

(87) PCT Pub. No.: WO2013/044382

PCT Pub. Date: Apr. 4, 2013

(65) Prior Publication Data

US 2014/0245910 A1 Sep. 4, 2014

Related U.S. Application Data

(60) Provisional application No. 61/541,236, filed on Sep. 30, 2011.

(51) Int. Cl.

| | |
|---|---|
| ***B31F 1/07*** | (2006.01) |
| ***B41K 3/26*** | (2006.01) |
| ***B41F 19/02*** | (2006.01) |
| ***B42D 15/00*** | (2006.01) |

(Continued)

(52) U.S. Cl.

CPC ..... *B41K 3/263* (2013.01); *B31F 1/07* (2013.01); *B41F 19/02* (2013.01); *B42D 15/00* (2013.01); *B44B 5/0047* (2013.01); *B44B 5/026* (2013.01)

(58) Field of Classification Search

CPC ... B41K 3/263; B31F 2201/0712; B31F 1/07

See application file for complete search history.

(56) References Cited

U.S. PATENT DOCUMENTS 4,836,721 A * 6/1989 Campling ..... B44B 3/061 144/135.4

5,713,702 A * 2/1998 Turner ..... B23B 41/006 408/100

(Continued)

OTHER PUBLICATIONS

International Search Report issued in PCT/CA2012/050649, 3 pages, mailed Jan. 16, 2013.

*Primary Examiner* — David Banh

(74) *Attorney, Agent, or Firm* — IPLM Group, P.A.

(57) ABSTRACT

An embossing head for use in a rotary printing press has a raised embossing stamp, a constraining means for constraining motion of the embossing stamp along a radial direction, and adjustable positioning means for stopping radially downward motion of the embossing stamp at an adjustable lowermost position for determining an adjustable radial height of the raised embossing stamp. A number of embossing heads may be mounted independently to annular collars of the press to enable free positioning of the corresponding embossments in both dimensions of the sheet material. The adjustable positioning means enables fine height selection and adjustment of each embossing stamp individually so as to enable and facilitate the production of embossments on sheet material within specified tolerances reliably over numerous print cycles.

13 Claims, 7 Drawing Sheets

(51) Int. Cl.
*B44B 5/00* (2006.01)
*B44B 5/02* (2006.01)

(56) References Cited

U.S. PATENT DOCUMENTS 5,778,774 A * 7/1998 Lavoie ..... B31F 1/07 101/28
5,823,691 A * 10/1998 Langner ..... B41J 3/32 101/18
6,099,177 A * 8/2000 Ito ..... B44B 5/0019 101/3.1
2004/0035305 A1 2/2004 Strasser
2005/0022680 A1 2/2005 Plattet
2006/0225579 A1* 10/2006 Errera ..... A21C 11/02 99/388
2009/0295104 A1* 12/2009 Cover ..... B25G 3/26 279/83
2012/0000081 A1* 1/2012 Kawaguchi ..... D05C 7/04 33/18.1
2012/0012016 A1 1/2012 Moeller
2012/0053034 A1* 3/2012 Diehr ..... B31B 1/00 493/55

* cited by examiner

DETAIL C

TACTILE FEATURE TOOL

BACKGROUND OF THE INVENTION

1. Field of the Invention

The invention relates generally to secure documents and more particularly to systems and methods for providing tactile features on secure documents.

2. Description of the Related Art

Vision-impaired persons benefit from the inclusion of standardized 'readable' tactile features on documents and other items which enable them to determine important information regarding the item. For example, the Braille system of writing, one form of standardized tactile feature, has opened to the vision-impaired all the wealth of knowledge previously accessible only to those with unimpaired or correctable vision. Braille has also been used to enhance non-literary items such as signage, thus enabling the vision-impaired to interpret better such items and providing to them a greater degree of independence. Tactile features have also found use by those with unimpaired vision, but under circumstances where normal visual reading or inspection proves inconvenient or difficult, as when an otherwise readable item is poorly lit. For example, so-called "night writing", a forerunner to Braille, was created by Charles Barbier de la Serre for use by Napoleon's soldiers to communicate silently and without light at night.

One innovative use of tactile writing has been the inclusion of tactile features on secure documents such as banknotes and identity documents such as passports. In International Patent Application No. WO/2000/051824 published Sep. 8, 2009 ["WO824"], the present applicant discloses a system and method for making banknotes having a tactile feature identifying a denomination of the banknote, thus enabling a vision-impaired person to determine easily the value of a handled banknote. This feature also enables a person with unimpaired vision to determine a banknote's denomination without requiring visual inspection, for example when adequate illumination is unavailable or when thumbing through the contents of a wallet or purse.

One challenge in providing readable tactile features on widely-circulated secure documents such as banknotes is that their frequent use ordinarily involves the repeated application of pressure against the tactile feature via a fingertip of a person or particularly by components of mechanical counting machines and currency dispensers. Consequently, the tactile features must be sufficiently durable if they are to remain substantially undamaged for the expected lifespan of the document. WO824 provides a solution to this problem wherein a sheet material forming the document is embossed so as to create the tactile features, and these are then reinforced in order to provide durability. Before being able to reinforce the embossments, however, it is first necessary to have a reliable and efficient means of producing the embossments.

Known methods for producing embossments in sheet materials typically involve equipment configurations which do not enable individual adjustment of each of the many embossments to be produced in the sheet material, either during an initial configuration of the equipment or during document production.

It is known in the art of document production to use numbering presses having numerous separately mountable numbering heads. The use of modular numbering heads enables greater flexibility in making adjustments as well as preparing a desired arrangement of printing members. The tolerances required for such numbering heads are greater (i.e. more lenient) than those required for the production of the embossments described above (e.g. ±30 μm), however, as such numbering heads are used typically to transfer ink from an ink cylinder to the sheet material and not to produce reliably-sized embossments.

There is thus a need for an apparatus and a method for producing in sheet materials numerous embossments which economizes time and effort to enable production at the tolerances required for durable tactile features on secure documents and which economizes time and effort to make adjustments and to change document configurations during a production run.

BRIEF SUMMARY OF THE INVENTION

The above-described advantages are provided by the embodiments described hereinafter.

The embodiments described herein provide an embossing head for use in a rotary printing press. The press has upper and lower rotary cylinders, and the upper rotary cylinder has a number of annular collars mounted to it. Any desired spacing of the collars along a longitudinal axis of the upper rotary cylinder may be selected, and the spacing may be equal and regular or unequal and irregular. Each collar has one or more embossing heads mounted to it. Where a number of embossing heads are mounted on a collar, they may be spaced equally and regularly around a circumference of the collar, or they may be spaced unequally and irregularly such that the circumferential position of any particular embossing head is independent of the circumferential position of any other embossing head. Each embossing head has one or more modular embossing plate assemblies which present raised embossing features for producing embossments in sheet material. A relative height of each embossing plate assembly is independently adjustable within the embossing head, and therefore a relative height of the corresponding raised embossing features is independently adjustable when the embossing head is mounted in the press.

Accordingly, a first embodiment includes an embossing head for use in a printing press to produce embossments on a sheet material. The embossing head comprises at least one embossing plate assembly, a mounting block, and an adjustable positioning means for each embossing plate assembly. Each embossing plate assembly comprises a raised embossing feature extending vertically upwardly from an upper surface of the embossing plate assembly. The mounting block is for reversibly coupling with each embossing plate assembly to substantially constrain motion of the embossing plate assembly to a vertical direction. The mounting block comprises a mounting apparatus for rigidly and reversibly mounting the mounting block to the printing press. Each adjustable positioning means is coupled to the mounting block and contacts the corresponding embossing plate assembly for stopping vertical downward motion of the embossing plate assembly at a selectable lowermost vertical position and for maintaining coupling of the embossing plate assembly with the mounting block. The adjustable positioning means is adjustable to raise or lower the lowermost vertical position to thereby select a corresponding vertical position of an upper surface of the embossing feature relative to the mounting block.

A second embodiment includes an embossing apparatus comprising a stamp cylinder assembly and an anvil cylinder assembly disposed adjacent and opposing the stamp cylinder assembly such that respective axes of rotation of the stamp cylinder assembly and the anvil cylinder assembly are parallel. The stamp cylinder assembly comprises an annular collar and a cylindrical axle. The annular collar is mounted coaxially to the cylindrical axle. The anvil cylinder assembly comprises an anvil plate and a cylindrical drum. The anvil plate is mounted to the cylindrical drum. The embossing apparatus further comprises a plurality of the embossing heads described above in the first embodiment mounted to the collar. For each of the embossing heads, the upper surface of each embossing plate assembly faces radially outwardly from the axis of rotation of the stamp cylinder assembly. The adjustable positioning means of each embossing plate assembly is independently adjustable. The stamp cylinder assembly and the anvil cylinder assembly are respectively disposed so as to receive therebetween a sheet material and so as to form in the sheet material, for each embossing plate assembly, an embossment when the embossing plate assembly and the anvil plate sandwich the sheet material under pressure.

A third embodiment includes an apparatus for producing embossments on a sheet material. The apparatus comprises an upper rotary cylinder and an opposing lower rotary cylinder for sandwiching the sheet material to produce the embossments. The upper rotary cylinder has mounted thereto a plurality of embossing heads. The upper rotary cylinder is characterized by a longitudinal rotational axis. Each embossing head comprises a raised embossing stamp, constraining means, and adjustable positioning means. The raised embossing stamp is on an upwardly facing surface of the embossing head facing outwardly in a radial direction perpendicular to the longitudinal rotational axis when the embossing head is mounted to the upper rotary cylinder. The constraining means constrains motion of the embossing stamp along the radial direction. The adjustable positioning means stops radially downward motion of the embossing stamp at an adjustable lowermost position for determining an adjustable radial height of the raised embossing stamp. The radial height of the raised embossing stamp of each of the plurality of embossing heads is independently adjustable.

Thus, with use of the embossing heads as described herein with the collars and cylinders of a typical printing press, it becomes possible to produce in sheet material any desired pattern or arrangement of embossments. Since each individual embossing plate assembly having embossing features in each embossing head has a height which is independently adjustable, the amount of time and effort required to provide all of the desired embossments in a document with the requisite tolerances is considerably reduced. Moreover, if any particular embossment falls outside of such tolerances during a print production run, relatively little time and effort is required to adjust that embossment. In addition, the amount of time and effort required to reconfigure the press for a different pattern of embossments is considerably reduced as the embossing plate assemblies are modular and may be individually swapped or rotated to provide the different pattern. Moreover, if the very same local patterns of embossments are desired but arranged differently across the sheet material, the very same embossing heads may simply be mounted at correspondingly different positions on each collar, and each collar may be mounted at correspondingly different positions on the corresponding cylinder of the press, and thus the very same equipment may be used.

BRIEF DESCRIPTION OF THE DRAWINGS

An understanding of the exemplary embodiments will be obtained from the following description, with reference to the following drawings in which:

FIG. 2A shows a perspective view, FIG. 2B shows a plan view, FIG. 2C shows a side view, FIG. 2D shows an end view, and FIGS. 2E & 2F show cross-sectional views AA & BB as specified in FIG. 2B.

Where appropriate, the same reference numerals are used in the drawings to indicate like features in all of the drawings.

DETAILED DESCRIPTION OF AN EXEMPLARY EMBODIMENT OF THE INVENTION

Figure 1A:
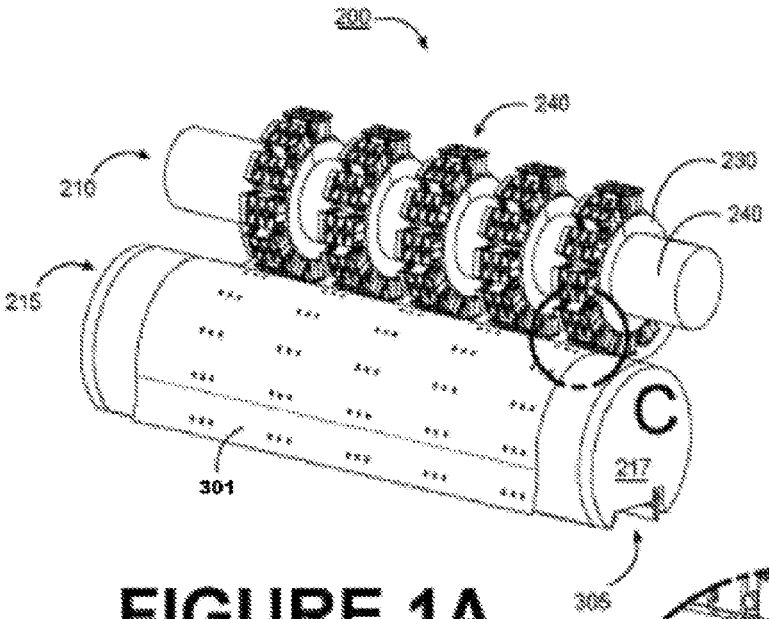
FIG. 1A shows a rotary embossing press employing embossing heads, and a detail view of a portion thereof.

An exemplary embodiment of the invention will now be described. While the invention is described by way of such embodiment, it is to be understood that the description is not intended to limit the invention to such embodiment, but is intended to cover alternatives, equivalents, and modifications which may be broader than the embodiment, but which are included within the scope of the appended claims.

In an effort to prevent obscuring the invention at hand, only details germane to implementing the exemplary embodiment will be described in great detail, since it is appreciated that peripheral details will be presently understood by persons skilled in the art.

As shown in the drawings, the exemplary embodiment may include duplicates or pluralities of certain parts or features. For the sake of convenience and clarity, and where identifying each and every instance would cause confusing clutter, only a single, exemplary instance may be identified using a reference character in the drawing with the understanding that, unless explicitly stated otherwise in the corresponding text or otherwise necessarily required to avoid an absurdity, such reference is intended to designate each and every respective one of the duplicates or plurality of parts or features.

In FIG. 1A there is shown an apparatus 200 including a rotary embossing press for producing embossments in a sheet material including any medium known in the art of document embossment. For example, the sheet material may be composed of paper, plastic, polymer, or a mixture of any of these, and may include other constituents, and may be fed to the apparatus 200 as a plurality of individual sheets or alternatively as a continuous web fed from a roll. The press generally includes a first, upper rotary cylinder assembly which may be termed the stamp cylinder assembly 210, and a parallel second, lower rotary cylinder assembly which may be termed the anvil cylinder assembly 215. The anvil cylinder assembly 215 is disposed adjacent and opposing the stamp cylinder assembly 210 such that the respective axes of rotation of the cylinders are parallel and such that, in operation, the respective cylinders rotate in opposite directions. A number of substantially identical annular collars 230 may be mounted coaxially to a cylindrical axle 240 of the stamp cylinder assembly 210 and spaced apart along a longitudinal axis of the axle 240. The anvil cylinder assembly 215 includes an anvil plate 301 mounted to a cylindrical drum 217.

Figure 1B:
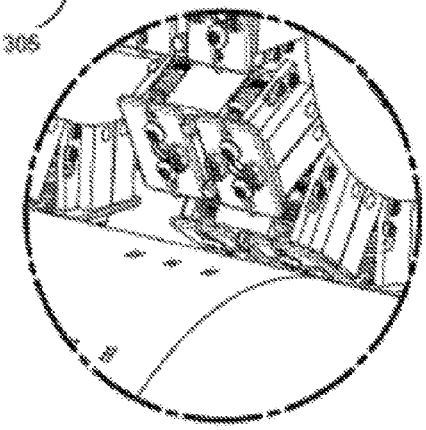
FIG. 1B shows a partial view of one of the collars and mounted embossing heads of the rotary embossing press of FIG. 1A.
Figure 1B:
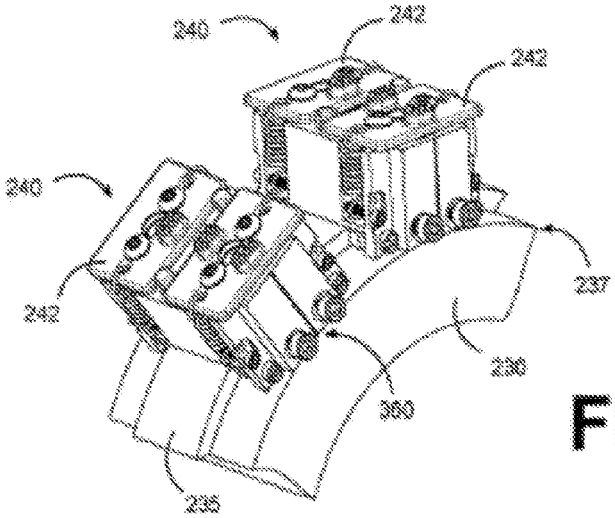

FIG. 1B shows a partial view of a portion of one of the collars 230. The collar 230 may be provided along an outermost radial surface of the collar with a mounting ridge 235. The mounting ridge 235 may have any convenient cross-sectional shape, and in the present embodiment may be trapezoidal or rectangular in cross-section. A number of embossing heads 240 may be mounted to the mounting ridge 235 of each collar 230 in a circumferentially spaced-apart fashion (as shown particularly in FIG. 1A), such that an embossing plate 242 of each embossing head 240 (as shown particularly in FIG. 1B) faces radially outwardly with respect to a rotational axis of the stamp cylinder assembly 210. In particular, as further described below, the mounting ridge 235 may be configured to form a dovetail with a clamp assembly 360 of the embossing heads 240.

The embossing heads 240 will now be described in detail with reference to FIGS. 2A-2F. Terms of relative orientation or position such as "upward", "downward", "above", "below", and so forth are to be understood with reference to the orientation of the embossing head shown in FIG. 2A, which shows an illustrative perspective view of the embossing head 240. By comparison to FIGS. 1A & 1B, it will be appreciated that, when mounted to the mounting ridge 235 of a collar 230 of the stamp cylinder 210 as described above, terms of relative orientation or position such as "upward" are to be understood as being synonymous with "radially outwardly" with respect to the rotational axis of the stamp cylinder 210, and similarly terms such as "downward" are to be understood as being synonymous with "radially inwardly".

Figure 2:
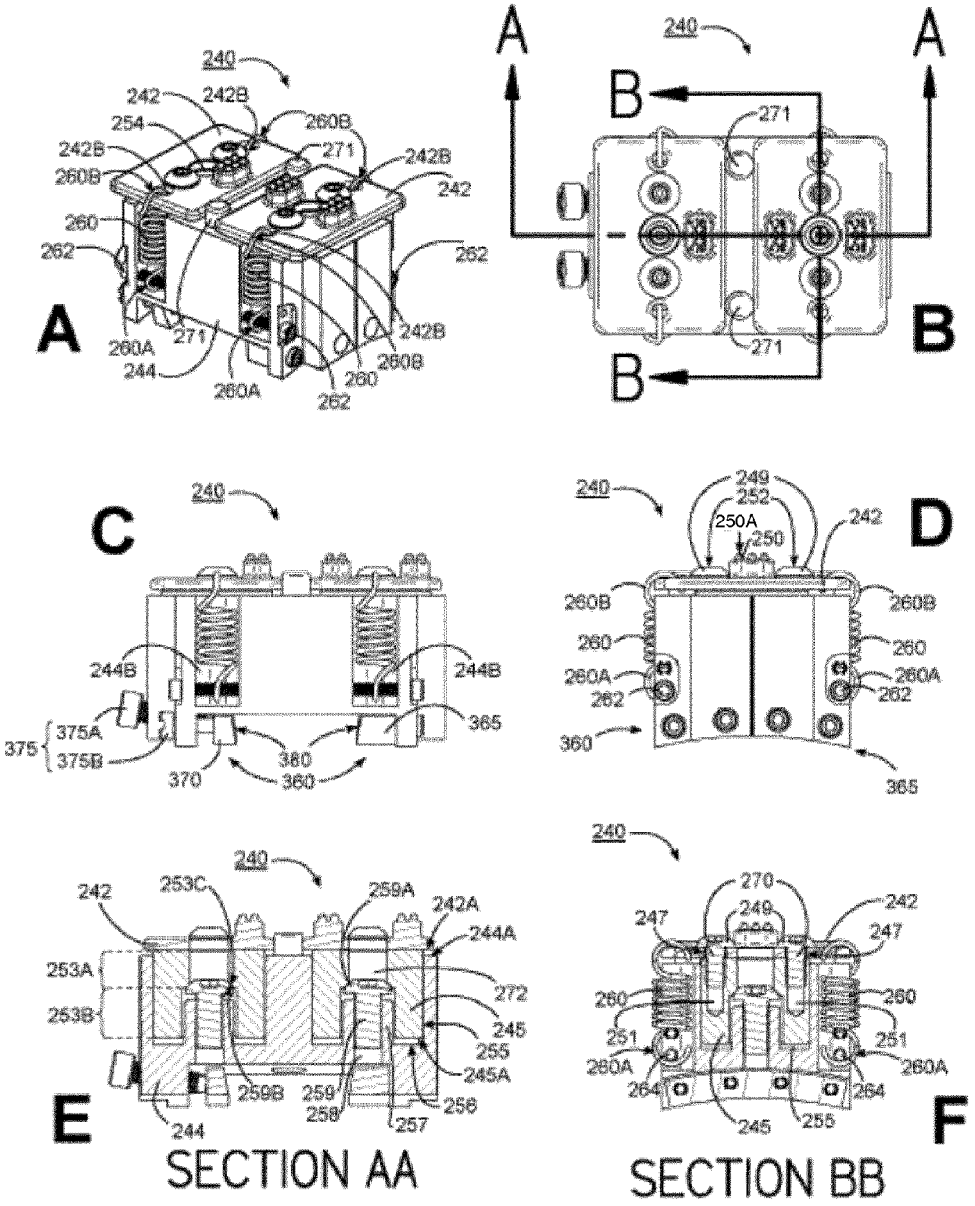
FIGS. 2A-2F show views of an embossing head for use in the rotary embossing press of FIG. 1A. In this regard.

Turning now to FIGS. 2A-2F, and particularly FIG. 2A, each embossing head 240 comprises a mounting block 244 and an embossing plate 242 detachably mounted to the mounting block 244. The embossing head 240 may have a single embossing plate 242 or may have more than one embossing plate 242. The embodiment depicted in FIGS. 2A-2F, for example, has two embossing plates 242.

Figure 3A:
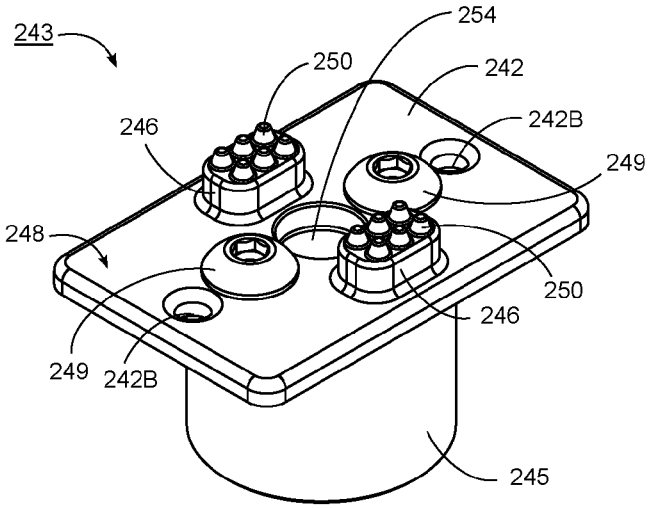
FIG. 3A shows a perspective view of an embossing plate assembly having two embossing units.
Figure 3B:
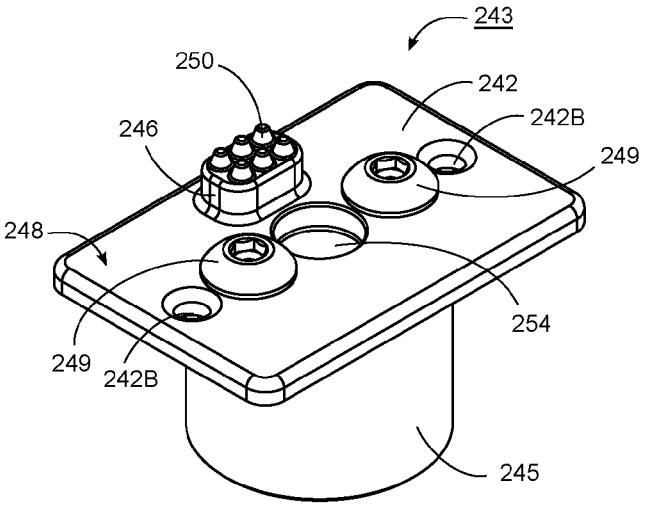
FIG. 3B shows a perspective view of an embossing plate assembly having one embossing unit.

As shown in FIG. 3, each embossing plate 242 forms a part of an embossing plate assembly 243 including the embossing plate 242 and a mounting piston 245. The embossing plate 242 has an integral or durably affixed embossing unit 246 extending upwardly from an upper surface 248 of the embossing plate 242. As shown in FIG. 3A, the embossing plate 242 may have one or more embossing units 246. The embossing plates 242 depicted in FIGS. 3A & 3B have respectively two and one embossing units 246. Each embossing unit 246 has at least one raised embossing feature 250 extending upwardly from an upper surface of the embossing unit 246. Each embossing unit may have more than one embossing feature 250, and as depicted in each case the embossing unit 246 has six embossing features 250. Each embossing unit 246 may be disposed on the embossing plate 242 at any suitable position, and the shape, number, and arrangement of embossing features 250 on each embossing unit 246 may be provided according to the particular embossments ultimately to be produced in the sheet material. The embossing plate 242 may be provided with a number of openings whose position, dimensions, and use are further described below.

As shown particularly in FIG. 3, in order to mount detachably the embossing plate 242 to the mounting block 244 of the embossing head 240, the embossing plate 242 may be detachably fastened to a cylindrical mounting piston 245. As particularly illustrated in FIG. 2F, the embossing plate 242 may be provided with one or more openings 247, each opening 247 permitting passage therethrough of a fastener 270 such as a screw or bolt having a flanged head 249, and the mounting piston 245 may be provided with a corresponding number of mating threaded bores 251 for receiving the fasteners 270 to fasten clampingly and reversibly the embossing plate 242 to the mounting piston 245. As will become apparent below, and with reference in particular to FIG. 2D, in one embodiment these fasteners 270 and the flanged heads 249 are so dimensioned and disposed such that when the embossing plate 242 is fastened to the mounting piston 245, the height of an uppermost surface 252 of the flanged head 249 is below a height of the uppermost surface 250A of the embossing features 250. In other words, when the embossing head 240 is assembled and mounted to a collar 230 of the stamp cylinder assembly 210, it is the embossing features 250, and in particular their uppermost surfaces 250A, which is disposed at the greatest radial outward extent.

With reference in particular to FIG. 2E, the mounting piston 245 may be further provided with a central longitudinal bore 272, and the embossing plate 242 may be further provided with a central opening 254, as particularly shown in FIG. 3B, which aligns with the longitudinal bore 272 of the mounting piston 245 when the embossing plate 242 is fastened thereto as described above. The dimensions and use of these features will become apparent below.

The mounting block 244 of the embossing head 240 may be fashioned from an integral block of rigid material. As shown particularly in FIGS. 2E & 2F, the mounting block 244 is provided with a bore 255 and upwardly-facing opening thereof (not shown, covered by the embossing plate 242) which are dimensioned to receive slidingly the mounting piston 245 in a closely-fitting fashion. For example, the bore 255 may be cylindrical and dimensioned such that a circular cross-section of the bore 255 is only slightly larger than a circular cross-section of the corresponding mounting piston 245 such that when the mounting piston 245 is inserted into the bore 255 the mounting piston 245 is constrained rigidly upright, i.e. it is substantially prevented from motion otherwise than along a common longitudinal axis of the mounting piston 245 and the bore 255. The respective materials of the mounting block 244 and mounting piston 245 may be selected so as to provide a very close fit between the mounting piston 245 and the bore 255 of the mounting block 244, and also to reduce friction inhibiting free sliding of the mounting piston 245 in the bore 255. For example, the mounting block 244 may be fashioned from steel, and the mounting piston 245 may be fashioned from brass. Persons skilled in the art will be able to select suitable alternative materials consist with the functional requirements specified herein.

As shown particularly in FIGS. 2A & 2B, the mounting block 244 may further have integral or durably fastened alignment posts 271 which are dimensioned and disposed to make close sliding contact with corresponding adjacent edges of the embossing plate 242. Where the embossing head 240 has two embossing plates 242 as shown, each alignment post makes close sliding contact with each embossing plate 242 on a correspondingly opposite side of the alignment post 271. The close sliding contact made by the alignment posts 271 with the respective embossing plates 242 prevents rotation of the respective embossing plates 242 and the corresponding embossing plate assemblies 243 more generally about the longitudinal axis of the corresponding mounting piston 245 and bore 255. Thus, in cooperation with the close sliding fit of each mounting piston 245 and the corresponding bore 255 in the mounting block 244, the alignment posts 271 constrain motion of each embossing plate assembly 243 and hence each embossing plate 242 to linear translation along the longitudinal axis of the corresponding mounting piston 245 and bore 255.

As noted above, the mounting piston 245 may be provided with a central longitudinal bore 272, and the embossing plate 242 may be provided with a central opening 254 which aligns with the longitudinal bore 272 of the mounting piston 245 when the embossing plate 242 is fastened thereto as described above. The dimensions and use of these features in cooperation with the mounting block 244 of the embossing head 240 will now be described.

As particularly shown in FIG. 2E, the mounting block 244 of the embossing head 240 may be configured and dimensioned so as to include within the bore 255 of the mounting block 244 and extending upwardly from a bottom surface 256 of the bore 255 a boss 257 including a central threaded bore 258 for receiving a mating adjustable stopping member 259 such as a screw or bolt. Alternatively, the boss 257 may be omitted and the threaded bore 258 may extend into a floor of the bore 255. The mounting piston 245 may be configured such that the longitudinal bore 253 of the mounting piston 245 has a first cross-sectional diameter along a narrow section 253A of the bore 253, and a second cross-sectional diameter along a wide section 253B of the bore 253, the narrow section 253A being disposed above the wide section 253B. The wide section 253B may be dimensioned so as to clear the boss 257 thus enabling the mounting piston 245 to be slid downwardly into the bore 255 of the mounting block 244 without hindrance by the boss 257. The narrow section 253A of the bore 253 of the mounting piston 245 may be dimensioned so as to be smaller in cross-section than a cross-section of a head 259A of the adjustable stopping member 259 such that the narrow section 253A prevents passage of the head 259A of the stopping member 259 upwardly therethrough. The head 259A of the stopping member 259 is dimensioned so as to be smaller in cross-section than the cross-section of the wide section 253B, however, such that the wide section 253B enables passage of the head 259A of the stopping member 259 therein without hindrance.

A height of an upper surface 259B of the head 259A of the adjustable stopping member 259 may be adjusted by advancing or retreating the stopping member 259 within the threaded bore 258 of the boss 257 in the manner known in the art, for example by rotating the stopping member 259 clockwise to advance it downwardly or counter-clockwise to retreat it upwardly. When the upper surface 259B of the head 259A of the stopping member 259 comes into contact with and abuts a shoulder 253C formed at the transition between the narrow 253A and wide 253B sections of the bore 253 of the mounting piston 245, it prevents further downward motion of the mounting piston 245 in the bore 255 of the mounting block 244 of the embossing head 240 and thus defines a lowermost position of the embossing plate assembly 243 relative to the mounting block 244 of the embossing head 240. The shoulder 253C may be chamfered so as to provide a bearing surface for flush contact with an annular portion of the upper surface 259B of the head 259A of the stopping member 259.

As described above, and as shown particularly in FIGS. 2E & 3, the embossing plate 242 may be mounted to the mounting piston 245 at an upper end thereof proximate the narrow section 253A of the bore 253 of the mounting piston 245. As shown in FIGS. 2E & 2F, the embossing plate 242 may be mounted to the mounting piston 245 such that a plane of the embossing plate 242 is perpendicular to the longitudinal axis of the mounting piston 245 which is the direction of motion to which the mounting piston 245 is constrained when inserted in the bore 255 of the mounting block 244, as described above. Thus, motion of the mounting piston 245 upwardly and downwardly within the bore 255 of the mounting block 244 results in motion of the embossing plate 242 in a direction correspondingly perpendicular to a plane of the embossing plate 242. The embossing plate 242 is dimensioned in the plane of the embossing plate 242 larger than the cross-section of the bore 255 of the mounting block 244. In the absence of the adjustable stopping member 259, therefore, a lower surface 242A of the embossing plate 242 thus abuts an upper surface 244A of the mounting block 244 about the upper opening of the bore 255 when the mounting piston 245 is lowered within the bore 255 to the fullest extent enabled thereby. Alternatively, the bore 255 and the mounting piston 245 may be so respectively dimensioned longitudinally that a bottom surface 245A of the mounting piston 245 abuts the bottom surface 256 of the bore 255 before the bottom surface 242A of the embossing plate 242 comes into contact with the upper surface 244A of the body 244. As described above, however, in an ordinary configuration of the embossing head 240, the adjustable stopping member 259 is present and is dimensioned and positioned so as to stop the downward motion of the mounting piston 245 before either extreme is met.

As shown particularly in FIG. 2A, the embossing head 240 may further comprise one or more restoring members 260 such as one or more tension springs which may be tensioned in the direction of motion of the embossing plate assembly 243, i.e. a direction substantially parallel to the longitudinal axis of the mounting piston 245. Each restoring member 260 may be mounted at a lower end thereof to the mounting block 244 by means of a fastener 262 such as a pin, screw or bolt passing transversely through a C-shaped lower end 260A of the restoring member, in which case the mounting block 244 may be provided with corresponding unthreaded or threaded channels 264 (as shown particularly in FIG. 2F) for receiving the fastener 262. The restoring member 260 may be mounted at an upper end thereof to the embossing plate 242 adjacent a side of the embossing plate 242 wherein a C-shaped upper end 260B of the restoring member 260 is passed through an opening 242B in the embossing plate 242 (shown particularly in FIGS. 2A & 3) dimensioned to receive threadingly the C-shaped end 260B of the restoring member 260. The mounting block 244 may be provided with a channel 244B (shown particularly in FIG. 2C) for receiving a body of the restoring member 260 and allowing unimpeded longitudinal alignment of the restoring member 260 and extension and contraction of the restoring member 260 along the channel 244B between the respective mounting points of the restoring member 260. As illustrated particularly in FIGS. 2A & 2D, the embossing head 240 may be provided with two such restoring members 260 for each embossing plate 242, with each restoring member 260 disposed on respectively opposite sides of the corresponding embossing plate 242, which is therefore provided with two corresponding openings 242B for mounting the respective upper ends 260B of the restoring members 260. In such a case, the mounting block 244 may have two channels 244B for receiving the two corresponding restoring members 260, as described above, and be provided with two fasteners 262 at the respective lower ends 260A of the restoring members 260 for mounting them as described above. The restoring member 260 may be mounted at a small angle from parallel to the longitudinal axis of the mounting piston 245 in order to avoid scratching or other contact with surfaces of the channels 244B.

Thus, when the embossing plate assembly 243 is mounted to the mounting block 244 of the embossing head 240 by insertion of the mounting piston 245 in the bore 255 of the mounting block 244, and when the restoring members 260 are mounted to the embossing plate 242 as described above, the restoring members 260 continuously urge the embossing plate assembly 243 downwardly to the lowermost position of the embossing plate assembly 243. As also described above, the adjustable stopping member 259 within the bore 255 of the mounting block 244—and particularly, the upper surface 259B of the head 259A of the adjustable stopping member 259—effectively defines the lowermost position of the embossing plate assembly 243. Since the restoring members 260 do not prevent utterly upward motion of the embossing plate assembly 243, but instead urge it to its lowermost position, the adjustable stopping member 259 may be used effectively to select the tensioned vertical position of the embossing plate assembly 243 and thus the height of the embossing plate 242, the embossing units 246 thereof, and the embossing features 250 thereon.

Figure 4A:
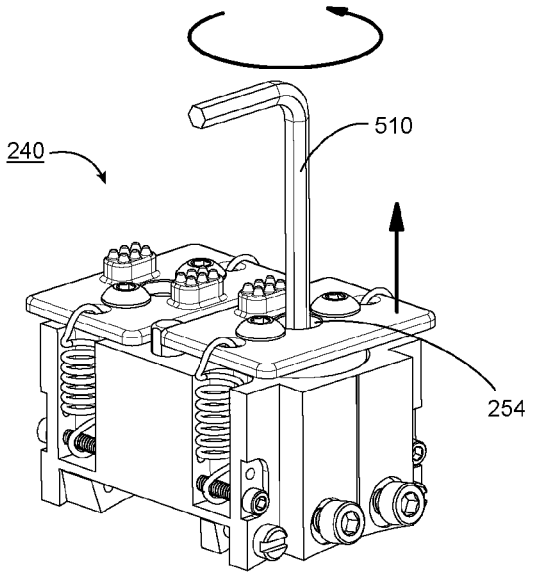
FIG. 4A shows a perspective view and FIG. 4B shows a cross-sectional view of an embossing head illustrating the use of a tool to adjust an adjustable stopping member.
Figure 4B:
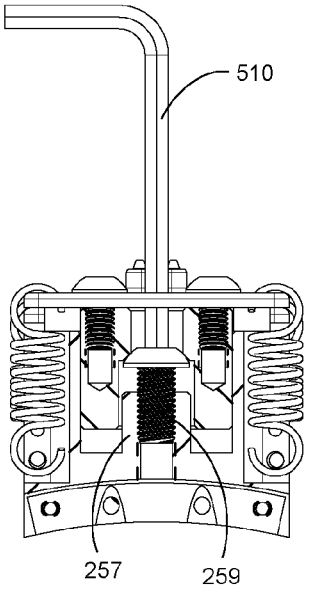

In this manner, adjustment (including advancement or retreat) of the adjustable stopping member 259 enables, in combination with the restoring members 260, controllable selection of an elevation of the embossing plate 242. The precision of such adjustment may be selected via a selection of the adjustable stopping member 259. For example, where the adjustable stopping members 259 is a threaded screw or bolt, then the degree of adjustment precision may be selected based on the pitch of the thread of the adjustable stopping member 259 and, correspondingly, the mating threaded bore 258. The close, sliding fit of the mounting piston 245 within the bore 255 of the mounting block 244 maintains the orientation of the plane of the embossing plate 242 relative to the longitudinal motion of the embossing plate 242. The close sliding contact of the alignment posts 271 and corresponding edges of the embossing plates 242 maintains the rotational position of each embossing plate 242 about its corresponding longitudinal axis. In order to provide easy access to the adjustable stopping member 259, and as noted above, the embossing plate 242 may include an opening 254 configured to be aligned with the narrow section 253A of the bore 272 of the mounting piston 245 when the embossing plate 242 is mounted thereto. As shown particularly in FIGS. 4A & 4B, this enables the passage through the opening 254 in the embossing plate 242 and the narrow section 253A of the bore 272 of a tool 510 such as a screwdriver or Allen wrench to adjust, by turning for example, the adjustable stopping member 259 thereby advancing or retreating it within the threaded post 257 and thereby raising or lowering it along with the tensioned embossing plate assembly.

The adjustable stopping member 259 and the restoring members 260 together constitute a precision positioning means for the embossing plate assembly 243. Persons skilled in the mechanical engineering arts will appreciate that alternative positioning means may be substituted for the particular means described above in order to enable the precise positioning of the embossing plate assembly 243 and hence the embossing plate 242 and embossing features 250 extending upwardly therefrom. For example, one or more springs may alternatively be disposed within bore 255 of the mounting block 244 and coupled to the bottom surface 256 of the bore 255 or to boss 257 on one end, and to the mounting piston 245 on another end to urge downward motion of the embossing plate assembly 243 in a similar manner. Alternatively, the two-part adjustable positioning means described above, with one part continuously urging downwardly and a second part presenting a stop to downward motion, may be replaced with a single adjustable positioning means which limits and sets both upward and downward motion. The embodiment including the adjustable stopping member 259 and the restoring members 260 described above provides the additional advantage, however, of enabling removal and replacement or rotation of the embossing plate assembly 243 without disturbing the setting of the adjustable stopping member 259 and thus the lowermost position of the embossing plate assembly 243 once reinstalled.

In order to mount the embossing head 240 to a collar 230 of the stamp cylinder assembly 210, the mounting block 244 may be provided with a clamp assembly 360 as particularly shown in FIGS. 1B, 2C & 2D for cooperation with the mounting ridge 235 of the collar 230. In order to mount the embossing head 240 rigidly and fittingly to the collar 230, the mounting block 244 may be configured on a bottom end thereof with a curvature 365, as shown particularly in FIG. 2D, corresponding to a curvature 237 of the collar, such that when the embossing head 240 is mounted on the collar 230 a bottom curved surface of the mounting block 244 abuts fittingly to the upper curved surface of the collar 230. The clamp assembly 360 of the mounting block 244 may be dimensioned and configured so as to receive the mounting ridge 235 of the collar when the embossing head 240 is placed on the collar 230 thereby allowing placement of the embossing head 240 on the collar 230 so as to bring into fitting contact the bottom curved surface of the mounting block 244 and the upper curved surface of the collar 230.

The clamp assembly 360 may comprise a stationary jaw 365 and a movable jaw 370 which, when the embossing head 240 is positioned on the collar 230 as indicated above, the stationary jaw 365 and the movable jaw 370 are disposed on opposite sides of the mounting ridge 235. The clamp assembly 360 may include adjusting members 375 such as screws or bolts for threading insertion into corresponding threaded bores (not shown) provided in the mounting block 244, with an end of each adjusting member 375 coupled rotatably to an outward-facing side of the movable jaw 370. In this fashion, the adjusting members 370 may be rotatably advanced or retreated within the threaded bores so as advance or retreat the movable jaw 370 toward or away from the stationary jaw 365, respectively. By adjusting the spacing between the stationary 365 and movable jaws 370 in this way, respective clamping surfaces 380 of the stationary 365 and movable jaws 370 may be brought into contact under pressure with facing surfaces of the mounting ridge 235, thereby rigidly clamping the clamping assembly 360, and thus the embossing head 240, to the mounting ridge 235 and collar 230.

As indicated above, and as particularly illustrated in FIG. 1A, a number of embossing heads 240 may be mounted to each collar 230 of the stamp cylinder 210. Since each embossing head 240 is mountable to the collar 230 independently of any other embossing head 240, the embossing heads 240 may be mounted to to the collars 230 in any arrangement which may be desired for a particular embossment outcome. For example, embossing heads 240 may be mounted to a collar 230 in a uniformly spaced-apart manner such that the circumferential spacing between any adjacent pair of embossing heads is equalized. Alternatively, the embossing heads 240 may be spaced unequally around the circumference of the collar 230 if desired. (As illustrated in FIG. 1A, the particular press in use may include in the anvil cylinder assembly 215, and correspondingly in the stamp cylinder assembly 210, a discontinuity or cut-out section 305 and as such would not include or permit the clamping of embossing heads thereto.) Similarly, while it is not essential to do so, it will typically be preferable to mount the collars 230 to the stamp cylinder 240 in a uniformly spaced-apart manner such that the spacing between any adjacent pair of collars 230 along the longitudinal direction of the stamp cylinder 240 is equalized. If desired, however, the collars 230 may be spaced unequally on the stamp cylinder 240, and moreover, the embossing heads 240 mounted to different collars 230 need not have the same circumferential arrangement.

Thus, the apparatus 200 enables any desired disposition and arrangement of embossing heads 240 both circumferentially on the corresponding collar 230, as well as any desired arrangement of collars 230 along the longitudinal axis of the stamp cylinder 210. With respect to the arrangement of documents to be embossed in the sheet material, this enables free placement of embossments in both planar dimensions of the sheet material. Moreover, since each embossing plate 242 is modular and replaceable, any desired type and arrangement of embossing features 250 may be provided so as to locate any desired embossment anywhere on the sheet material. Such an apparatus 200 also enables independent adjustment of each individual embossing plate assembly 243, and thus the contained set of embossing features 250, around the circumference of the corresponding collar 230 independently of any other embossing features. In contrast, the embossing features presented on a finished stamping plate 110 cannot generally be adjusted along the circumference of the collar 105 without physically stretching or otherwise altering the entire stamping plate 110.

In operation, the stamp cylinder assembly 210 and anvil cylinder assembly 215 of the rotary embossing press 200 are made to rotate in opposite directions about their respective longitudinal axes while so spaced as to bring into contact or close proximity and under pressure respective embossing plates 242 and cooperating portions of the anvil plate 301. More specifically, by selective rotation and spacing of the stamp cylinder assembly 210 and anvil cylinder assembly 215 in this way, the raised embossing units 246 included in each embossing head 240, and in particular the raised embossing features 250 included in each embossing unit 246, are brought into contact or close proximity with a corresponding portion of the anvil plate 301 under pressure. It will be appreciated that when the press 200 is operated thusly in the absence of any sheet material, the embossing features 250 will be brought into contact under pressure with the anvil plate 301. Conversely, if, as during normal productive operation, a sheet material is fed between the stamp cylinder assembly 210 and anvil cylinder 220, then the embossing features 250 will only come into close proximity to the anvil plate 301, being separated therefrom by the sheet material, which by virtue of the pressure applied between each embossing feature 250 and the corresponding portion of the anvil plate 301 will mechanically strain the sheet material at such interface so as to create an embossment corresponding generally to the shape and size of the embossing feature 250.

Figure 5:
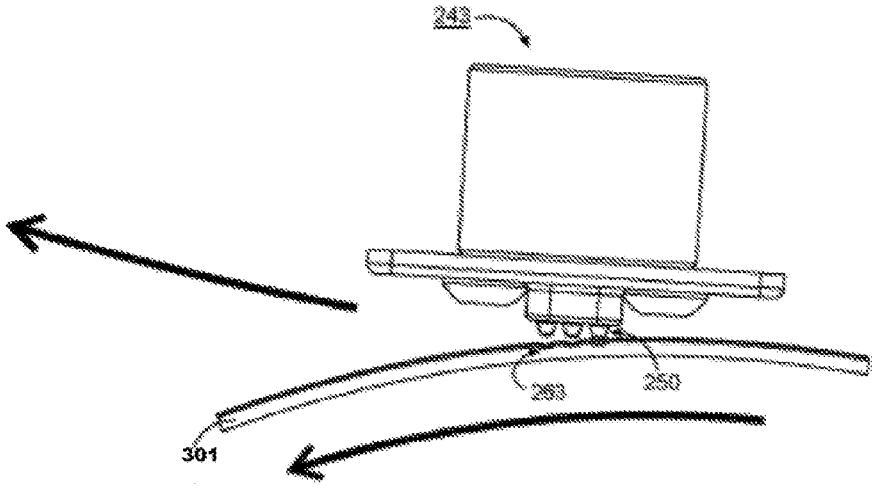
FIG. 5 shows a side view of an embossing plate assembly illustrating schematically the creation of embossments in an anvil plate.

With reference to FIG. 5, the anvil plate 301 (shown in partial view, wherein the anvil drum 217 is not shown) may comprise a sheet of compressible material such that when the embossing features 250 are brought into contact or close proximity under pressure with the anvil plate 301, the anvil plate 301 deforms in a respective portion 263 about each embossing feature 250, with the size and shape of each such deformation 263 being determined by the size and shape of the corresponding embossing feature 250, the amount of pressure applied between the embossing head 240 and the anvil plate 301, and the mechanical properties of the sheet material when fed therebetween. The anvil plate 301 may be formed of a compressible but elastic material, such that when the embossing head 240 is no longer applied under pressure to the anvil plate 301, the deformations 263 formed in the anvil plate 301 by the embossing features 250 revert to their original configuration, i.e. they disappear. Alternatively, and as particularly shown in FIG. 5, the anvil plate 301 may be formed of a compressible, but inelastic material such that when an embossing head 240 is no longer applied under pressure to the anvil sheet 260, the deformations 263 formed in the anvil plate 301 by the embossing features 250 remain imprinted at least somewhat in the anvil plate 301. The anvil plate 301 material may be selected so as to be generally resilient, but susceptible to durable imprint by the embossing features 250 of the embossing heads 240 after a number of repeated impressions. In this way, the anvil plate 301 may be prepared with an exact or near-exact negative of the embossing features 250. The anvil plate 301 prepared in this way may cooperate with and facilitate the embossing features 250 in the creation of embossments in the sheet material.

As discussed above, in an embodiment where the embossing plate 242 is detachably fastened to the cylindrical mounting piston 245 by means of fasteners 270 such as screws having a flanged head 249, the dimensions of the flanged head 249 are selected such that when in operation the uppermost surface 250A of the embossing features 250 comes into contact with the anvil plate 301 or sheet material sandwiched therebetween, but an uppermost surface 252 of the flanged head 249 does not come into contact with the anvil plate 301 or sheet material. Where the sheet material follows a rectilinear path, the flanged heads 249 are lower than the uppermost surface 250A of the embossing features 250. Where the anvil plate 301 and sheet material follow a curvilinear path, however, with the embossing features 250 contacting a convex surface of these, it may be possible for the uppermost surface 252 of the flanged head 249 to have the same height as the uppermost surface 250A of the embossing features 250 and nevertheless avoid contact between the flanged heads 249 and the anvil plate 301 or sheet material. Persons skilled in the art will recognize and be able to substitute different arrangements achieving the purpose of bringing only the embossing features 250 into contact with the anvil plate 301 or sheet material. For example, where the embossing plate 242 is integral with the mounting piston 245, fasteners 270 are not required and thus the flanged heads 249 are absent. In such case, and depending upon the geometry of the embossing plate 242 and the curvature of the anvil plate 301, the embossing units 246 may also be dispensed with, or they need not be configured to extend upwardly from the upper surface 249 of the embossing plate 242, and the embossing features 250 may be provided extending upwardly from the upper surface 249 of the embossing plate 242 while nevertheless enabling the bringing into contact of the embossing features 250 with the anvil plate 301 or sheet material without contacting any other portion of the embossing head 240.

The relative height of each embossing plate 242 is precisely adjustable by means of the adjustable stopping member 259 described above. By virtue of the durability and rigidity of the embossing head 240, including the rigidity with which the embossing plate assembly 243 is held upright and in a fixed orientation in the mounting block 244, and the rigidity with which the mounting block 244 is mountable to the mounting ridge 235 of the collar 230 mounted to the stamp cylinder 240, the spacing between the embossing features 250 of each embossing head 240 and the opposing portion of the anvil plate 301 can be precisely and reliable selected and maintained over a large number of operations of the rotary embossing press 200. Consequently, the height of the embossments imprinted in the sheet material may be likewise selected with precision and reliability. Given that the embossing plate 242 of each embossing head 240 may be independently adjusted in height, while retaining that selected height reliably over a large number of operations of the press 200, the numerous embossments imprinted over the entirety of the sheet material may have a precisely selected uniform height which is a considerable advantage in the production of a high volume of documents intended to be generally uniform in characteristics. Moreover, each and every embossing plate assembly 243 may be independently adjusted, thus simplifying considerably the process of making periodic corrective adjustments during the embossing production cycle.

Figure 6:
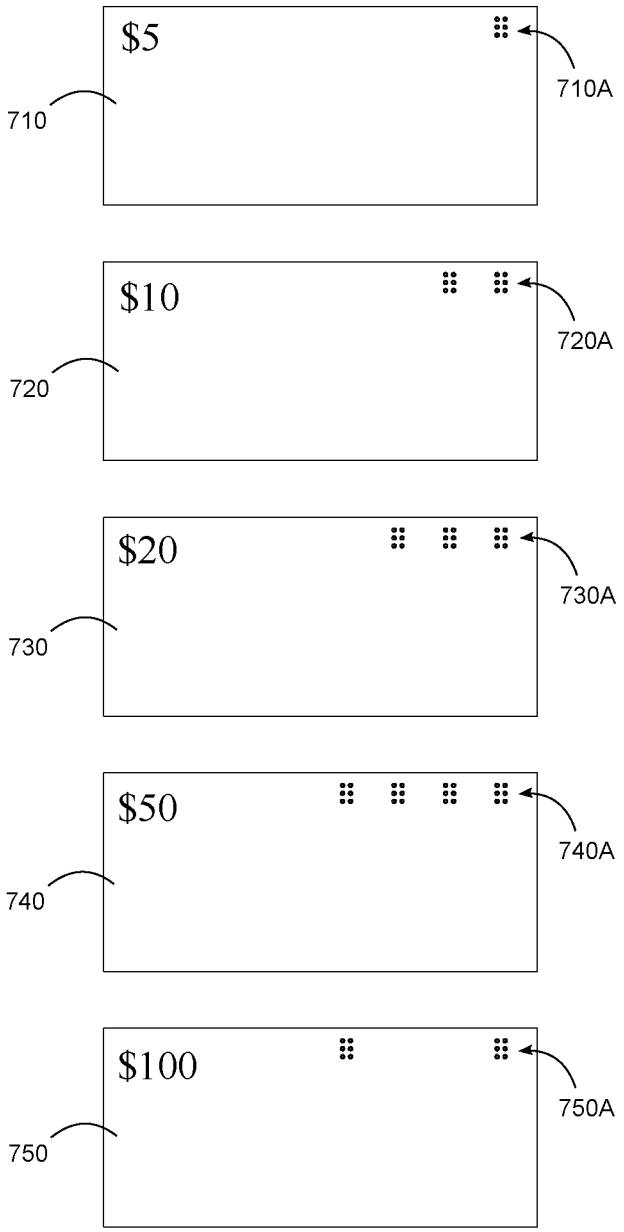
FIG. 6 shows schematically exemplary documents including embossments produced using the embossing press of FIG. 1A.
Figure 7:
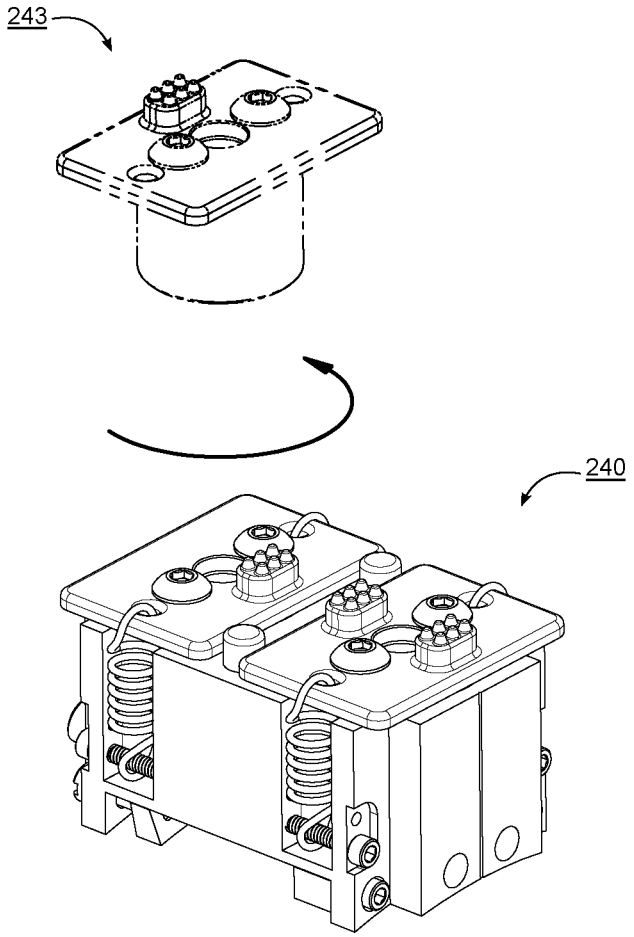
FIG. 7 shows the embossing head of FIG. 2 illustrating the removal, rotation, and replacement of one of the embossing plate assemblies for producing a different embossment pattern.

As noted above, one use for the embossing head and cooperating press described above may be for providing on secure documents tactile features which are readable by persons having impaired vision, for example using their fingertip in a manner known in the art. In one such embodiment, the document is a banknote and the tactile features identify a denomination of the banknote. As illustrated in FIG. 6, the different denominations of banknotes 710, 720, 730, 740, 750 may be encoded using four of the embossing units 246 described above according to the correspondence depicted. As shown in FIG. 3, the embossment plates may be configured with one or two such embossing units 246, and those with only embossing unit 246 may be rotated, as shown in FIG. 7, so as to shift the embossing units 246 to an adjacent position so as to enable the production of the different patterns of embossments on the banknotes as illustrated in FIG. 6. Where no embossments are required in the first or last two positions (as in the case of the $5 denomination, as shown in FIG. 6), then an embossment assembly 243 may be omitted from the corresponding location on the embossment head 240, or alternatively a blank embossing plate 242 having no embossing units 246 may be included.

It will be appreciated by persons skilled in the art that the materials forming the various components of the apparatus 200 may be selected from a variety of alternatives so long as they perform their desired functions as indicated herein either expressly or by necessary implication. In addition, it will be appreciated that the apparatus 200 is suitable for producing embossments in any sheet material susceptible of embossment which may be provided in any shape, form, or composition desired.

It is to be appreciated that the section headings appearing hereinbefore do not limit the scope of the invention as described but are merely intended to organize the description for the sake of clarity.

With the foregoing exemplary embodiments having been disclosed, it will be apparent to those skilled in the art that various changes and modifications can be made to appropriately suit the needs and objectives of another application and still achieve the advantages of the invention; all such changes and modifications are intended to fall within the scope of the invention as defined by the claims that follow.

What is claimed is:

1. An embossing head for use in a rotary printing press to produce embossments on a sheet material wherein the rotary printing press comprises an upper rotary cylinder having a longitudinal rotational axis and an opposing lower rotary cylinder for sandwiching the sheet material fed between the upper and lower rotary cylinders, the embossing head comprising:

at least one embossing plate assembly, each embossing plate assembly comprising at least one raised embossing feature extending vertically upwardly from an upper surface of the embossing plate assembly for forming at least one embossment on the sheet material;

a mounting block for reversibly coupling with each embossing plate assembly to substantially constrain motion of the embossing plate assembly to a vertical direction, wherein the mounting block comprises a mounting apparatus configured for rigidly and reversibly mounting the mounting block to the upper rotary cylinder of the rotary printing press; and for each embossing plate assembly, an adjustable positioning means comprising a restoring member coupled to the mounting block and the embossing plate assembly for continuously urging the embossing plate assembly vertically downwardly and for maintaining coupling of the embossing plate assembly with the mounting block, and an adjustable stopping member coupled to the mounting block and contacting the embossing plate assembly for stopping the vertical downward motion of the embossing plate assembly at a selectable lowermost vertical position, wherein the adjustable stopping member is adjustable to raise or lower the lowermost vertical position to thereby select a corresponding vertical position of an upper surface of the embossing feature relative to the mounting block.

2. An embossing head according to claim 1, wherein, for each embossing plate assembly: the embossing plate assembly comprises an embossing plate, wherein the upper surface of the embossing plate assembly is an upper surface of the embossing plate and the embossing plate assembly further comprises a mounting piston, wherein the embossing plate is mounted rigidly to the mounting piston at an upper end of the mounting piston, wherein the mounting block comprises a mounting block bore for slidingly and fittingly receiving the mounting piston at a lower end of the mounting piston opposite the upper end of the mounting piston to thereby substantially constrain motion of the mounting piston to a vertical axis of the mounting piston when the mounting piston is disposed within the mounting block bore.

3. An embossing head according to claim 2, wherein, for each embossing plate assembly: the adjustable stopping member is coupled to the mounting block at a lower end of the adjustable stopping member so as to extend upwardly from a bottom surface of the mounting block bore, wherein the mounting piston comprises a mounting piston bore having an upper section and a lower section, wherein a horizontal cross section of the upper section of the mounting piston bore is smaller than a horizontal cross section of the lower section of the mounting piston bore, wherein the upper section and lower section form a shoulder at a transition therebetween, wherein the adjustable stopping member comprises a head at an upper end of the adjustable stopping member, the head having a horizontal cross-section larger than the horizontal cross-section of the upper section of the mounting piston bore, the horizontal cross section of the head being smaller than the horizontal cross section of the lower section of the mounting piston bore, such that when the lower end of the mounting piston is slidingly received in the mounting block bore, the lower section of the mounting piston bore receives the head of the adjustable stopping member, and wherein vertical downward motion of the mounting piston is stopped when the head of the adjustable stopping member contacts the shoulder formed by the upper section and lower section of the mounting piston bore, thereby stopping vertical downward motion of the embossing plate assembly.

4. An embossing head according to claim 3, wherein, for each embossing plate assembly: the mounting block further comprises a boss extending upwardly from the bottom surface of the mounting block bore, wherein the adjustable stopping member is threadingly coupled to an upper end of the boss, and wherein a horizontal cross section of the boss is smaller than the horizontal cross section of the lower section of the mounting piston bore such that the lower section of the mounting piston bore receives the boss when the mounting piston is moved downwardly so as to dispose the lower end of the mounting piston below the upper end of the boss.

5. An embossing head according to claim 2, wherein, for each embossing plate assembly: each of the mounting block bore and the mounting piston is cylindrical.

6. An embossing head according to claim 1, wherein, for each embossing plate assembly: the adjustable stopping member is a screw or bolt, and wherein adjustment of the adjustable stopping member comprises rotating the screw or bolt in a first rotational direction to raise the lowermost vertical position and rotating the screw or bolt in a second rotational direction opposite the first rotational direction to lower the lowermost vertical position.

7. An embossing head according to claim 2, wherein, for each embossing plate assembly: the embossing plate further comprises an opening allowing passage of a tool therethrough to access the head of the adjustable stopping member for adjusting the adjustable stopping member when the embossing plate assembly is coupled to the mounting block.

8. An embossing head according to claim 1, wherein the restoring member comprises a tension spring.

9. An embossing head according to claim 1, wherein, for each embossing plate assembly: the vertical position of the upper surface of the embossing feature is adjustable to within ±30 μm relative to the mounting block when the mounting block is mounted to the upper rotary cylinder of the rotary printing press.

10. An embossing head according to claim 1, wherein the at least one embossing plate assembly comprises a plurality of embossing plate assemblies, and for each embossing plate assembly the adjustable positioning means is adjustable independently of the adjustable positioning means associated with any other embossing plate assembly such that the respective lowermost vertical positions of all of the embossing plate assemblies are independently adjustable.

11. An embossing head according to claim 1, wherein for each embossing plate assembly: the mounting block further comprises an alignment post disposed for close sliding contact with a corresponding adjacent edge of the embossing plate for preventing rotation of the embossing plate assembly about the vertical direction.

12. An embossing head according to claim 1 wherein a plurality of the embossing heads are mounted on the upper rotary cylinder of the rotary printing press, each of the plurality of the embossing heads being independently mountable at a different corresponding position around a circumference of the upper rotary cylinder.

13. An embossing head according to claim 12 and further comprising a plurality of collars configured for mounting to the upper rotary cylinder by spacing the collars along the longitudinal rotational axis of the upper rotary cylinder such that each collar is independently mountable to the upper rotary cylinder at a corresponding position along the longitudinal rotation axis of the upper rotary cylinder, and wherein each of the embossing heads is configured for mounting to a corresponding one of the collars.

* * * * *